US008884546B2

(12) United States Patent
Peng

(10) Patent No.: US 8,884,546 B2
(45) Date of Patent: Nov. 11, 2014

(54) DRIVING APPARATUS FOR LIGHT-EMITTING DIODE CURTAIN LAMP

(75) Inventor: Wen-Chi Peng, New Taipei (TW)

(73) Assignee: Semisilicon Technology Corp., New Taipei (TW)

( * ) Notice: Subject to any disclaimer, the term of this patent is extended or adjusted under 35 U.S.C. 154(b) by 555 days.

(21) Appl. No.: 13/232,932

(22) Filed: Sep. 14, 2011

(65) Prior Publication Data

US 2012/0098444 A1 Apr. 26, 2012

(30) Foreign Application Priority Data

Oct. 21, 2010 (TW) ..... 99220340 U

(51) Int. Cl.
*H05B 37/02* (2006.01)
*H05B 33/08* (2006.01)

(52) U.S. Cl.
CPC ..... *H05B 33/0824* (2013.01)
USPC ..... 315/291; 315/312

(58) Field of Classification Search
CPC .... H05B 37/00; H05B 37/02; H05B 33/0824; H04N 5/225; G03B 21/14
USPC ..... 315/193, 200 R, 209 R, 291, 307, 308, 315/312
See application file for complete search history.

(56) References Cited

U.S. PATENT DOCUMENTS

2008/0253122 A1* 10/2008 Hancock et al. ..... 362/251
2012/0050606 A1* 3/2012 Debevec et al. ..... 348/370

* cited by examiner

*Primary Examiner* — Jimmy Vu
(74) *Attorney, Agent, or Firm* — Chun-Ming Shih; HDLS IPR Services

(57) ABSTRACT

A driving apparatus for light-emitting diode curtain lamp is applied to a direct current power source and at least a light-emitting diode light string. The driving apparatus for light-emitting diode curtain lamp includes a master control unit, at least a slave control unit, and a transmission line. The master control unit is electrically connected to the direct current power source. The slave control unit is electrically connected to the master control unit and the light-emitting diode light string. The transmission line is electrically connected to the master control unit and the slave control unit. The slave control unit is controlled by the master control unit to drive the light-emitting diode light string. The transmission line is used to transit control signals and synchronous signals.

8 Claims, 10 Drawing Sheets

DRIVING APPARATUS FOR LIGHT-EMITTING DIODE CURTAIN LAMP

BACKGROUND OF THE INVENTION

1. Field of the Invention

The present invention relates to a driving apparatus for curtain lamp, and especially relates to a driving apparatus for light-emitting diode curtain lamp.

2. Description of Prior Art

There are two kinds of conventional driving apparatuses for light-emitting diode curtain lamp:

1. without microcontroller: this kind of driving apparatus would drive light-emitting diode curtain lamp as long as the driving apparatus receives power, but the light-emitting diode curtain lamp could not light vividly. It is very dull.

2. with microcontroller: this kind of driving apparatus usually includes three or four circuit loops to drive a plurality of light-emitting diode light strings. Because there are only three or four circuit loops, the light-emitting diode curtain lamp still could not light vividly. It still has the dull problem.

SUMMARY OF THE INVENTION

In order to solve the above-mentioned problems, an object of the present invention is to provide a driving apparatus for light-emitting diode curtain lamp to apply to a direct current power source.

In order to solve the above-mentioned problems, another object of the present invention is to provide a driving apparatus for light-emitting diode curtain lamp to apply to an alternating current power source.

In order to solve the above-mentioned problems, another object of the present invention is to provide a driving apparatus for light-emitting diode curtain lamp with single light-emitting diode in one light-emitting diode string.

In order to achieve the object of the present invention mentioned above, the driving apparatus for light-emitting diode curtain lamp of the present invention is applied to a direct current power source and at least a light-emitting diode light string. The driving apparatus for light-emitting diode curtain lamp includes a master control unit, at least a slave control unit, and a transmission line. The master control unit is electrically connected to the direct current power source. The slave control unit is electrically connected to the master control unit and the light-emitting diode light string. The transmission line is electrically connected to the master control unit and the slave control unit. The slave control unit is controlled by the master control unit to drive the light-emitting diode light string. The transmission line is used to transit control signals and synchronous signals.

In order to achieve another object of the present invention mentioned above, the driving apparatus for light-emitting diode curtain lamp of the present invention is applied to an alternating current power source and at least a light-emitting diode light string. The driving apparatus for light-emitting diode curtain lamp includes a master control unit, and at least a slave control unit. The master control unit includes a power negative terminal pin of master control unit, and a signal output pin of master control unit. The master control unit is electrically connected to the alternating current power source. The slave control unit includes a signal input pin of slave control unit, a signal output pin of slave control unit, a power positive terminal pin of slave control unit, and a power negative terminal pin of slave control unit. The slave control unit is electrically connected to the master control unit and the light-emitting diode light string. The slave control unit is controlled by the master control unit to drive the light-emitting diode light string. The signal output pin of master control unit is electrically connected to the signal input pin of slave control unit. The power negative terminal pin of master control unit is electrically connected to the power positive terminal pin of slave control unit.

In order to achieve another object of the present invention mentioned above, the driving apparatus for light-emitting diode curtain lamp with single light-emitting diode in one light-emitting diode string of the present invention is applied to at least a light-emitting diode. The driving apparatus for light-emitting diode curtain lamp with single light-emitting diode in one light-emitting diode string includes a master control unit and at least a slave control unit. The slave control unit is electrically connected to the master control unit and the light-emitting diode.

DETAILED DESCRIPTION OF THE INVENTION

Figure 1:
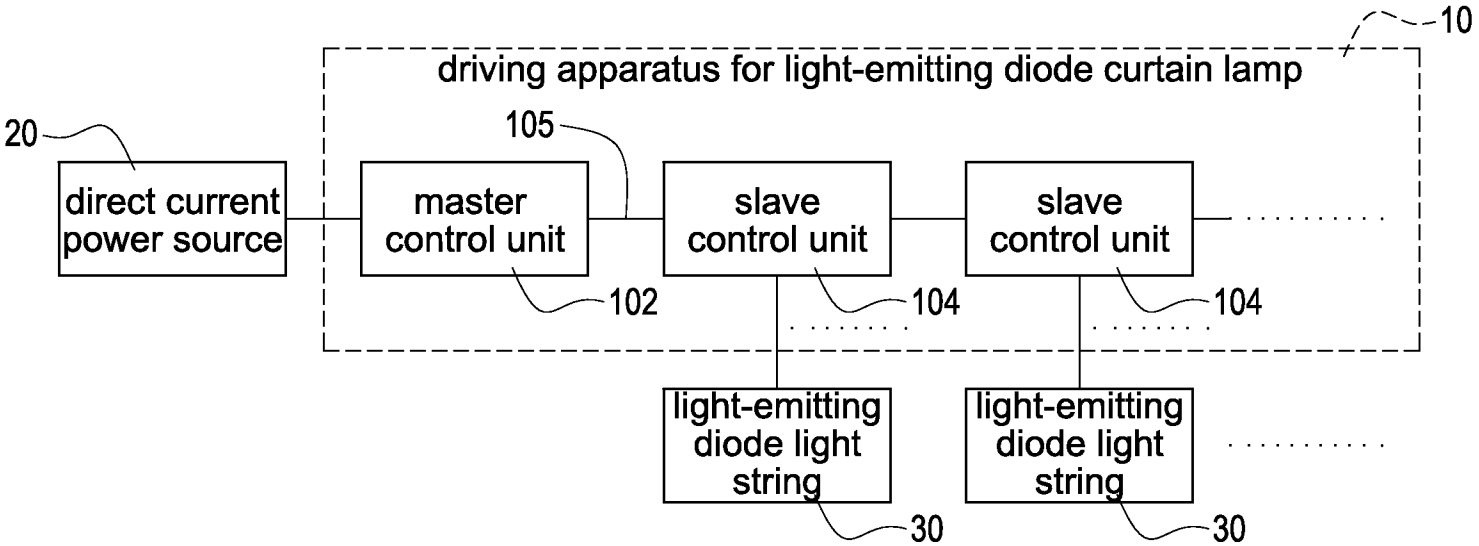
FIG. 1 shows a block diagram of the first embodiment of the driving apparatus for light-emitting diode curtain lamp of the present invention.

FIG. 1 shows a block diagram of the first embodiment of the driving apparatus for light-emitting diode curtain lamp of the present invention. The driving apparatus for light-emitting diode curtain lamp 10 of the present invention is applied to a direct current power source 20 and at least a light-emitting diode light string 30. The driving apparatus for light-emitting diode curtain lamp 10 includes a master control unit 102, at least a slave control unit 104, and a transmission line 105.

The master control unit 102 is electrically connected to the direct current power source 20. The slave control unit 104 is electrically connected to the master control unit 102 and the light-emitting diode light string 30. The transmission line 105 is electrically connected to the master control unit 102 and the slave control unit 104. The slave control unit 104 is controlled by the master control unit 102 to drive the light-emitting diode light string 30. The transmission line 105 is used to transit control signals and synchronous signals.

Figure 2:
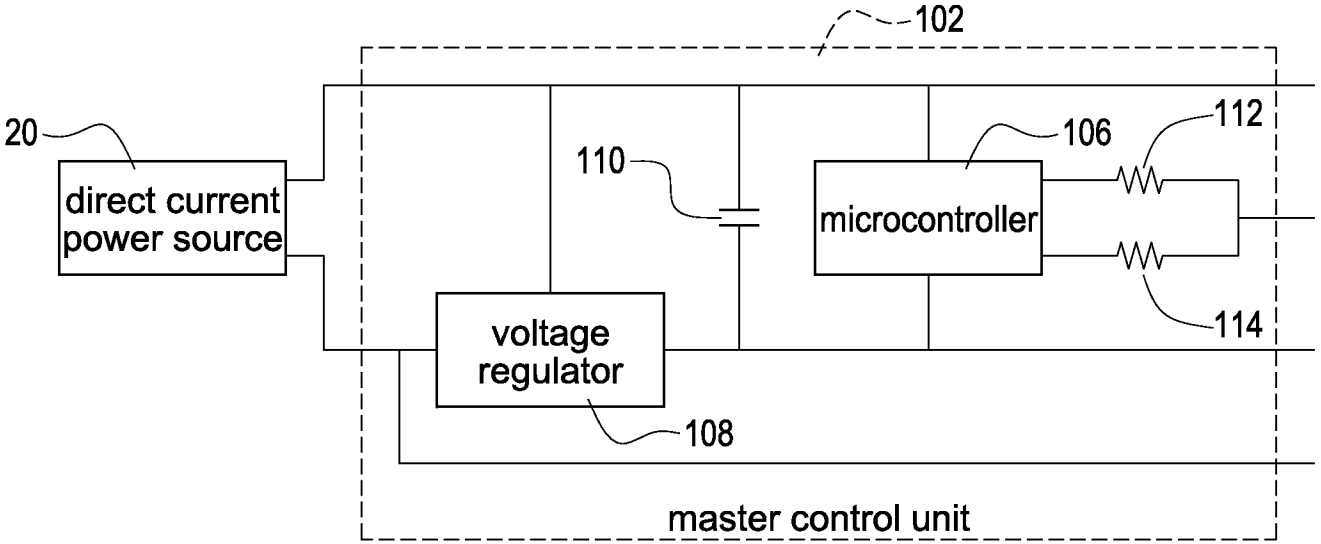
FIG. 2 shows a block diagram of the first embodiment of the master control unit of the present invention.

FIG. 2 shows a block diagram of the first embodiment of the master control unit of the present invention. The master control unit 102 includes a microcontroller 106, a voltage regulator 108, a first capacitor 110, a first resistor 112, and a second resistor 114.

The microcontroller 106 is electrically connected to the voltage regulator 108, the first capacitor 110, the first resistor 112, and the second resistor 114. The voltage regulator 108 is electrically connected to the direct current power source 20.

Figure 3:
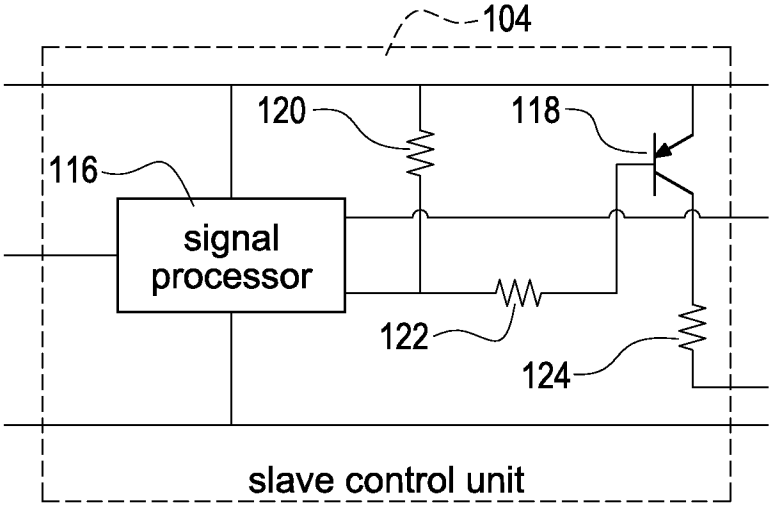
FIG. 3 shows a block diagram of the first embodiment of the slave control unit of the present invention.

FIG. 3 shows a block diagram of the first embodiment of the slave control unit of the present invention. The slave control unit 104 includes a signal processor 116, a transistor 118, a third resistor 120, a fourth resistor 122, and a fifth resistor 124.

The transistor 118 is electrically connected to the signal processor 116, the third resistor 120, the fourth resistor 122, and the fifth resistor 124.

The direct current power source 20 could be a 24 voltages direct current power source. The direct current power source 20 is the driving power for the master control unit 102 and the slave control unit 104. The master control unit 102 outputs signals to the first slave control unit 104. The first slave control unit 104 sends the signals to the second slave control unit 104 after the first slave control unit 104 receives the signals, and the remaining circuits have connections and operations following this manner.

The light-emitting diode light string 30 connected to the slave control unit 104 is driven by the slave control unit 104 when the slave control unit 104 receives the command to drive the light-emitting diode light string 30. Therefore, the light-emitting diode light strings 30 could be driven in regular turn, or in rhythm, or together. The brightness of the light-emitting diode light strings 30 could be controlled separately as well.

Please refer to FIG. 2 again. The direct current power source 20 includes two terminal pins, wherein the upper terminal pin is used to transit 24 voltages direct current voltages while the lower terminal pin is for power negative terminal.

The master control unit 102 includes four terminal pins in the right side, wherein the first terminal pin viewed from top to bottom direction is used to transit 24 voltages direct current voltages, and the second terminal pin viewed from top to bottom direction is used to transmit signals for controlling the slave control units 104 to drive the light-emitting diode light strings 30, and the third terminal pin viewed from top to bottom direction is used to transit 19 voltages direct current voltages outputted from the voltage regulator 108, and the fourth terminal pin viewed from top to bottom direction is for power negative terminal.

Please refer to FIG. 3 again. The slave control unit 104 includes three terminal pins in the left side, wherein the first terminal pin viewed from top to bottom direction is used to receive 24 voltages direct current voltages, and the second terminal pin viewed from top to bottom direction is used to receive signals from the master control unit 102, to drive the light-emitting diode light string 30, and the third terminal pin viewed from top to bottom direction is used to receive 19 voltages direct current voltages outputted from the voltage regulator 108.

The slave control unit 104 includes four terminal pins in the right side, wherein the first terminal pin viewed from top to bottom direction is used to transit 24 voltages direct current voltages, and the second terminal pin viewed from top to bottom direction is used to transmit signals for controlling the next slave control units 104 to drive the next light-emitting diode light strings 30, and the third terminal pin viewed from top to bottom direction is electrically connected to the light-emitting diode light strings 30 to drive the light-emitting diode light strings 30, and the fourth terminal pin viewed from top to bottom direction is used to transit 19 voltages direct current voltages.

The slave control unit 104 could control a plurality of the light-emitting diode light strings 30, so that the quantity of the slave control unit 104 is decreased to reduce the cost. The single master control unit 102 could control all of the slave control units 104.

Figure 4:
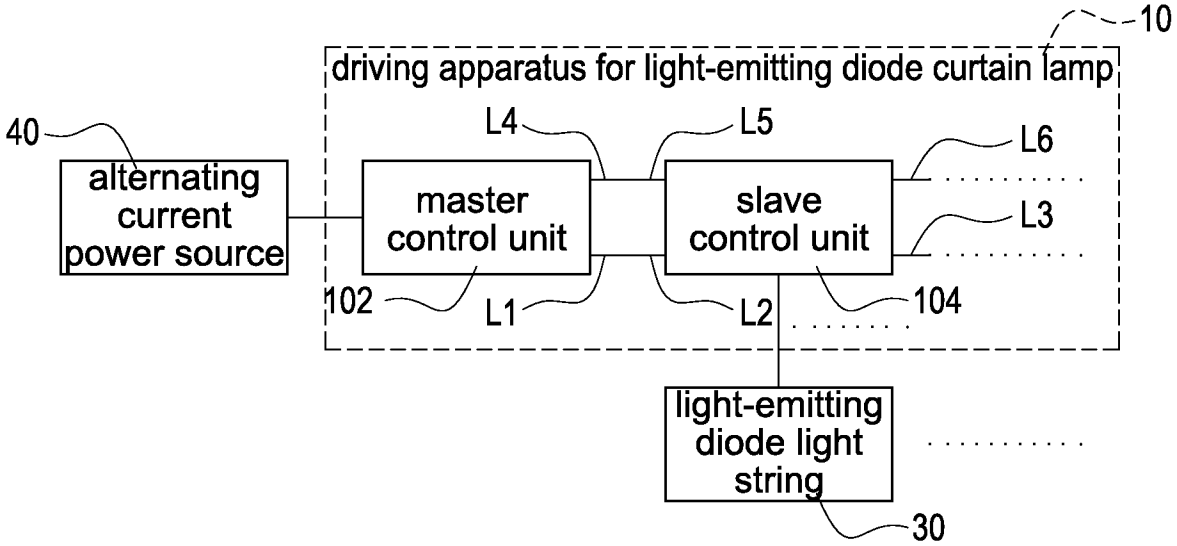
FIG. 4 shows a block diagram of the second embodiment of the driving apparatus for light-emitting diode curtain lamp of the present invention.

FIG. 4 shows a block diagram of the second embodiment of the driving apparatus for light-emitting diode curtain lamp of the present invention. The driving apparatus for light-emitting diode curtain lamp 10 of the present invention is applied to an alternating current power source 40 and at least a light-emitting diode light string 30. The driving apparatus for light-emitting diode curtain lamp 10 includes a master control unit 102, and at least a slave control unit 104.

The master control unit 102 includes a power negative terminal pin of master control unit L1, and a signal output pin of master control unit L4. The slave control unit 104 includes a signal input pin of slave control unit L5, a signal output pin of slave control unit L6, a power positive terminal pin of slave control unit L2, and a power negative terminal pin of slave control unit L3.

The signal output pin of master control unit L4 is electrically connected to the signal input pin of slave control unit L5. The power negative terminal pin of master control unit L1 is electrically connected to the power positive terminal pin of slave control unit L2. The slave control unit 104 is electrically connected to the light-emitting diode light string 30. The signal output pin of slave control unit L6 of the slave control unit 104 is electrically connected to the signal input pin of slave control unit L5 of the next slave control unit 104.

The power negative terminal pin of slave control unit L3 of the slave control unit 104 is electrically connected to the power positive terminal pin of slave control unit L2 of the next slave control unit 104. The alternating current power source 40 is electrically connected to the master control unit 102. The slave control unit 104 is controlled by the master control unit 102 to drive the light-emitting diode light string 30.

Figure 5:
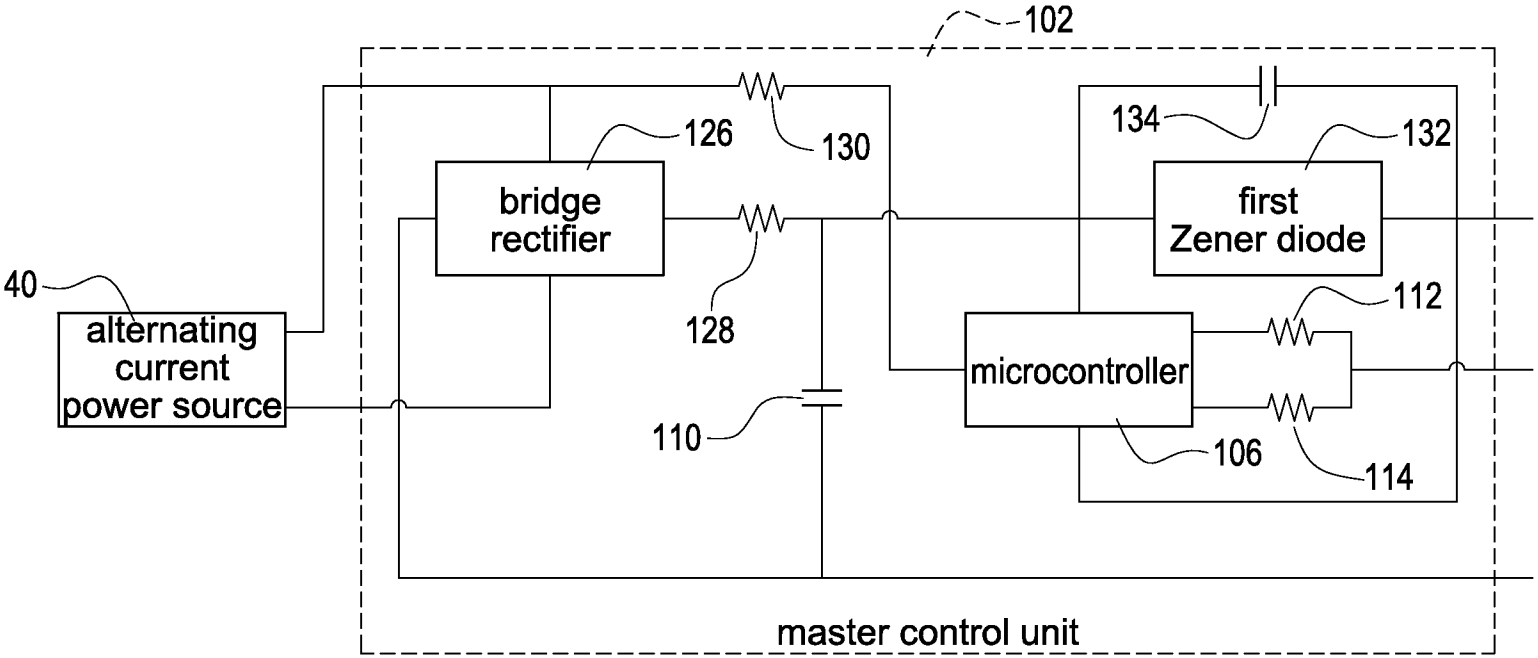
FIG. 5 shows a block diagram of the second embodiment of the master control unit of the present invention.

FIG. 5 shows a block diagram of the second embodiment of the master control unit of the present invention. The master control unit 102 includes a microcontroller 106, a bridge rectifier 126, a first resistor 112, a second resistor 114, a sixth resistor 128, a seventh resistor 130, a first capacitor 110, a first Zener diode 132, and a second capacitor 134.

The microcontroller 106 is electrically connected to the first resistor 112, the second resistor 114, the second capacitor 134, the first Zener diode 132, the seventh resistor 130, the sixth resistor 128, and the first capacitor 110. The bridge rectifier 126 is electrically connected to the alternating current power source 40, the first capacitor 110, the seventh resistor 130, and the sixth resistor 128.

Figure 6:
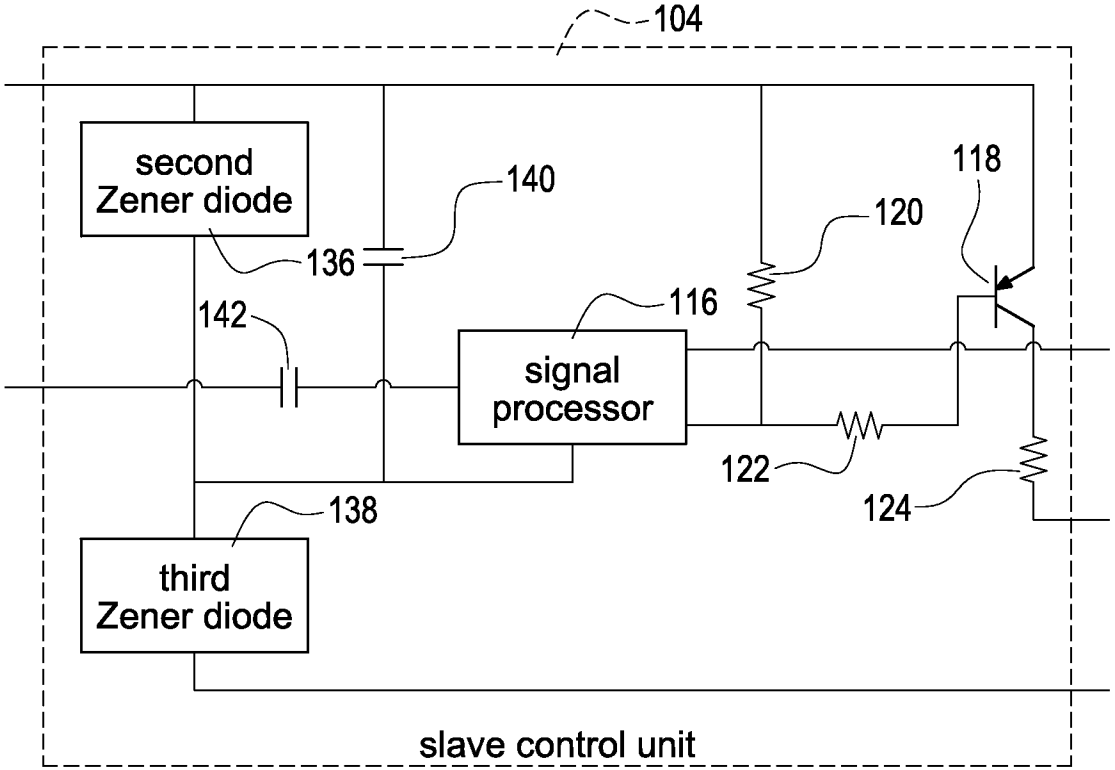
FIG. 6 shows a block diagram of the second embodiment of the slave control unit of the present invention.

FIG. 6 shows a block diagram of the second embodiment of the slave control unit of the present invention. The slave control unit 104 includes a signal processor 116, a transistor 118, a third resistor 120, a fourth resistor 122, a fifth resistor 124, a second Zener diode 136, a third Zener diode 138, a third capacitor 140, and a fourth capacitor 142.

The transistor 118 is electrically connected to the signal processor 116, the third resistor 120, the fourth resistor 122, the fifth resistor 124, the third capacitor 140, and the second Zener diode 136. The signal processor 116 is electrically connected to the fourth capacitor 142 and the third Zener diode 138.

The alternating current power source 40 could be a 120 voltages alternating current power source. In order to save power and solve the problem of voltages drop in the components, the power connections between the master control unit 102 and the slave control unit 104, and between the slave control units 104, are in serial type. The power positive terminal pin of slave control unit L2 of the slave control unit 104 is electrically connected to the power negative terminal pin of master control unit L1 of the master control unit 102. The power negative terminal pin of slave control unit L3 of the slave control unit 104 is electrically connected to the power positive terminal pin of slave control unit L2 of the next slave control unit 104. Therefore, the power connections are in serial type.

Because the power connections are in serial type, the electrical potential of each slave control units 104 is different. Therefore, special technic is required for the signal transmission. Moreover, the FIG. 6 shows the technic with capacitor type.

Please refer to FIG. 6 again. The slave control unit 104 includes two terminal pins in the left side, wherein the lower terminal pin is the signal input pin of slave control unit L5. The fourth capacitor 142 is used to filter the direct current of the signal. The signal is transmitted to the next slave control unit 104 through the signal output pin of slave control unit L6 after the signal is processed by the signal processor 116. The slave control unit 104 includes three terminal pins in the right side, wherein the first terminal pin viewed from top to bottom direction is the signal output pin of slave control unit L6.

The second Zener diode 136 could be a 4.7 voltages Zener diode. The third Zener diode 138 could be a 13 voltages Zener diode. The second Zener diode 136 and the third Zener diode 138 are used to clamp a stable voltage for driving the signal processor 116.

Another function of the second Zener diode 136 and the third Zener diode 138 are to construct the bypass current loop. The current supplied to the next slave control unit 104 is not enough when the slave control unit 104 is not driven. Therefore, the bypass current loop is constructed with the second Zener diode 136 and the third Zener diode 138.

Because the light-emitting diodes of the light-emitting diode light string 30 are in serial connection, the driving voltage for the light-emitting diode light string 30 must be large enough. According to the second Zener diode 136, the third Zener diode 138, the signal processor 116, and the transistor 118, the voltage used to drive the light-emitting diode light string 30 is raised to drive the light-emitting diodes of the light-emitting diode light string 30.

Please refer to FIG. 6 again. The slave control unit 104 includes two terminal pins in the right side, wherein the second terminal pin viewed from top to bottom direction is electrically connected to the light-emitting diode light string 30, and the third terminal pin viewed from top to bottom direction is the power negative terminal pin of slave control unit L3. If the slave control unit 104 controls a plurality of light-emitting diode light strings 30, a plurality of circuit loops constructed with the transistor 118, the third resistor 120, the fourth resistor 122, and the fifth resistor 124 will be required.

The slave control unit 104 includes two terminal pins in the left side, wherein the upper terminal pin (power positive terminal pin of slave control unit L2) is electrically connected to the power negative terminal pin of master control unit L1. The slave control unit 104 mentioned above is the first slave control unit 104. The power positive terminal pin of slave control unit L2 of the other slave control unit 104 is electrically connected to the power negative terminal pin of slave control unit L3 of the prior slave control unit 104.

Please refer to FIG. 5 again. The bridge rectifier 126 and the first capacitor 110 are used to transfer a high alternating current voltage to a high direct current voltage. The first Zener diode 132 is used to clamp a stable direct current voltage to supply to the microcontroller 106. The first terminal pin viewed from top to bottom direction in the right side of the master control unit 102 is used to transit power to the first slave control unit 104.

The signal controlling the light-emitting diode light strings 30 is transited to the first slave control unit 104 through the second terminal pin viewed from top to bottom direction in the right side of the master control unit 102. The negative pole of the high direct current voltage is electrically connected to the negative pole of the last slave control unit 104. Therefore, a complete loop for alternating current voltage transferring to direct current voltage is constructed.

The light-emitting diode light string 30 mentioned above includes a plurality of light-emitting diodes. However, the light-emitting diode light string 30 could include single light-emitting diode. It is called the driving apparatus for light-emitting diode curtain lamp with single light-emitting diode in one light-emitting diode string of the present invention.

Figure 7:
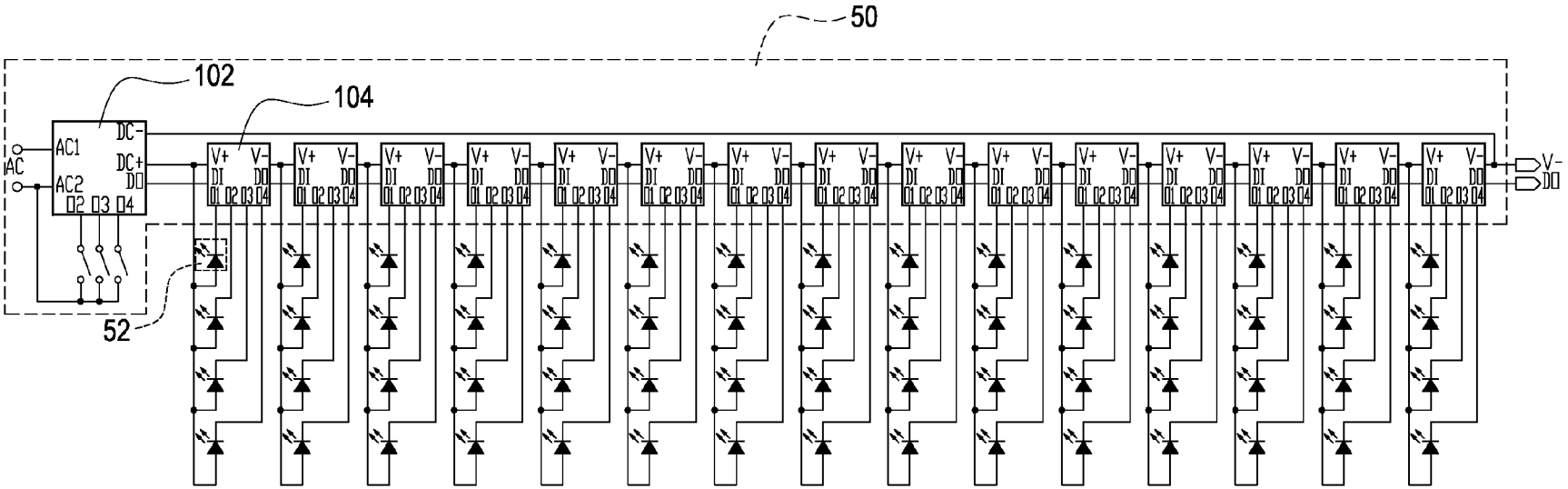
FIG. 7 shows a circuit diagram of the light-emitting diode curtain lamp with single light-emitting diode in one light-emitting diode string (for alternating current power source).
Figure 8:
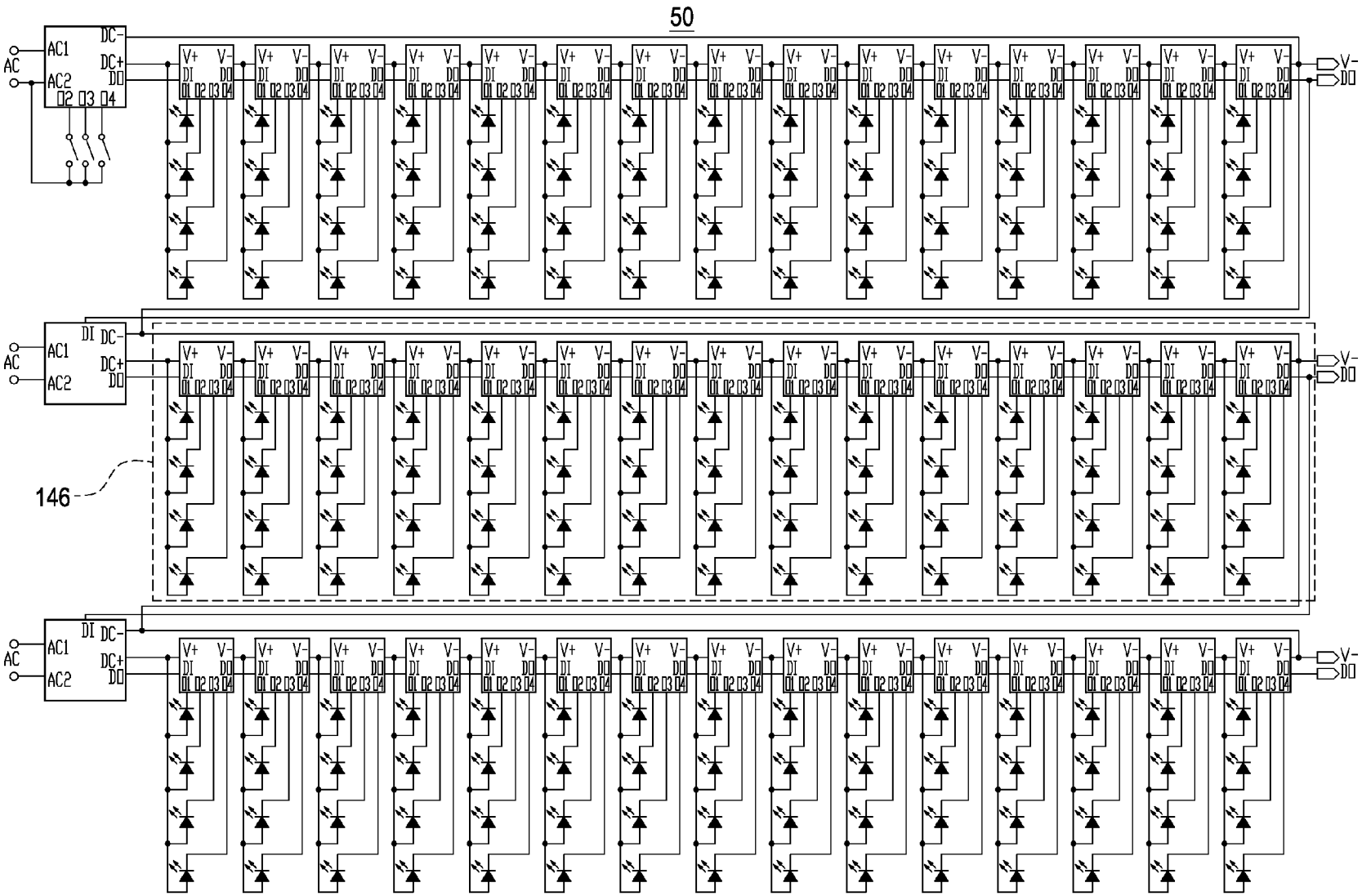
FIG. 8 shows a circuit diagram of a plurality of the light-emitting diode curtain lamp with single light-emitting diode in one light-emitting diode string (for alternating current power source).
Figure 9:
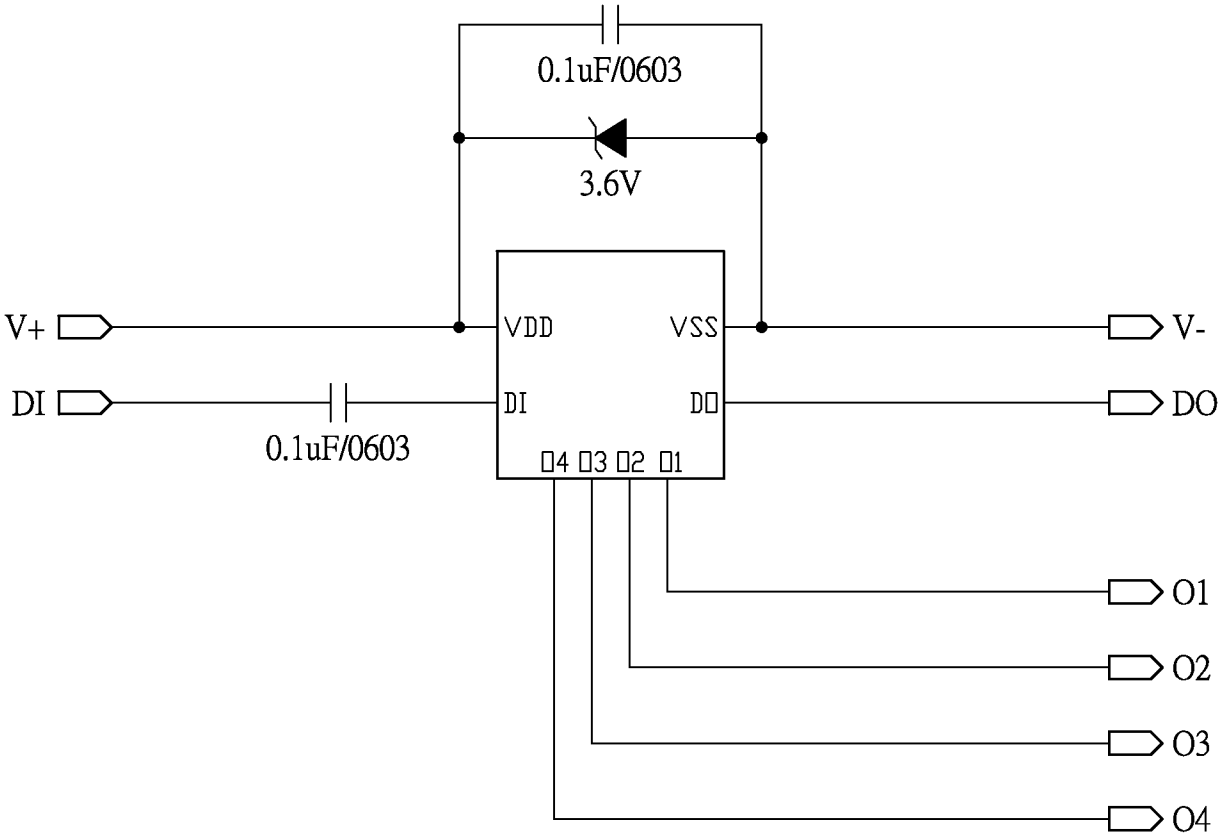
FIG. 9 shows a circuit diagram of the slave control unit of the light-emitting diode curtain lamp with single light-emitting diode in one light-emitting diode string.

FIG. 7 shows a circuit diagram of the light-emitting diode curtain lamp with single light-emitting diode in one light-emitting diode string (for alternating current power source). FIG. 8 shows a circuit diagram of a plurality of the light-emitting diode curtain lamp with single light-emitting diode in one light-emitting diode string (for alternating current power source). FIG. 9 shows a circuit diagram of the slave control unit of the light-emitting diode curtain lamp with single light-emitting diode in one light-emitting diode string. The principles are same as before. Therefore, it would be omitted here.

The driving apparatus for light-emitting diode curtain lamp with single light-emitting diode in one light-emitting diode string 50 is applied to at least a light-emitting diode 52. The driving apparatus for light-emitting diode curtain lamp with single light-emitting diode in one light-emitting diode string 50 includes a master control unit 102 and at least a slave control unit 104. The slave control unit 104 is electrically connected to the master control unit 104 and the light-emitting diode 52.

Figure 10:
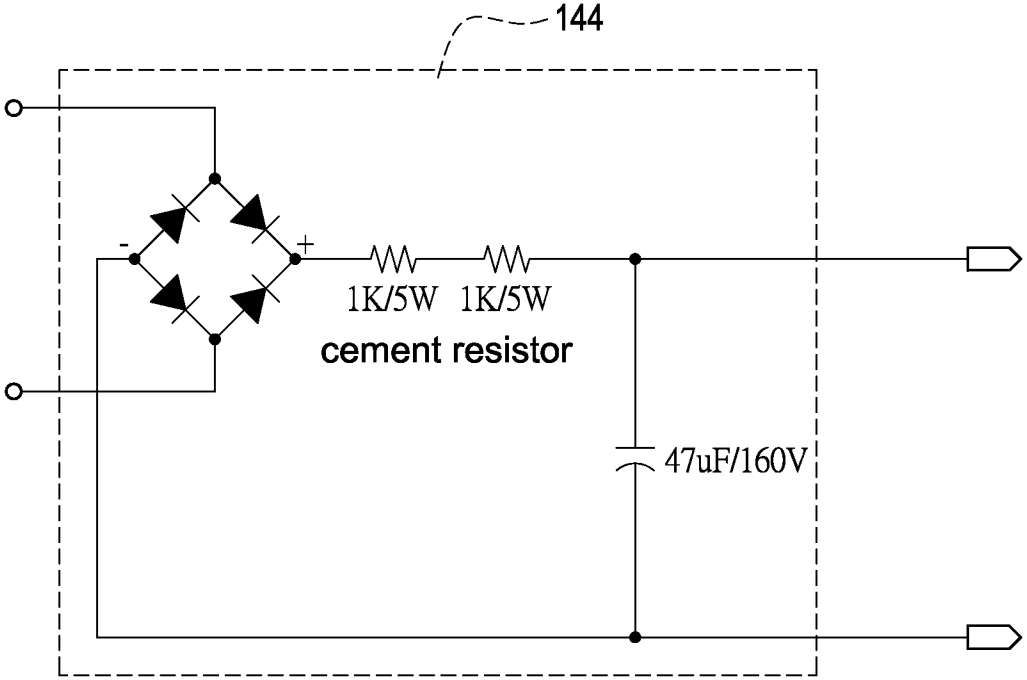
FIG. 10 shows a circuit diagram of the secondary power supply of the light-emitting diode curtain lamp with single light-emitting diode in one light-emitting diode string.

FIG. 10 shows a circuit diagram of the secondary power supply of the light-emitting diode curtain lamp with single light-emitting diode in one light-emitting diode string. The driving apparatus for light-emitting diode curtain lamp with single light-emitting diode in one light-emitting diode string 50 of the present invention only needs a master control unit 102, but an alternating current voltage transferring to direct current voltage circuit 144 (the secondary power supply) is required.

Please continue using FIG. 2 and FIG. 3. Please refer to FIG. 8 and FIG. 10 as well. The master control unit 102 includes a microcontroller 106. The slave control unit 104 includes a signal processor 116. The driving apparatus for light-emitting diode curtain lamp with single light-emitting diode in one light-emitting diode string 50 further includes an alternating current voltage transferring to direct current voltage circuit 144 and a second curtain lamp 146. The alternating current voltage transferring to direct current voltage circuit 144 is electrically connected to the slave control unit 104. The second curtain lamp 146 is electrically connected to the alternating current voltage transferring to direct current voltage circuit 144.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A driving apparatus for light-emitting diode curtain lamp applied to a direct current power source and at least a light-emitting diode light string, the driving apparatus for light-emitting diode curtain lamp including:

a master control unit electrically connected to the direct current power source, including:

a microcontroller; and a voltage regulator electrically connected to the microcontroller;

at least a slave control unit electrically connected to the master control unit and the light-emitting diode light string; and a transmission line electrically connected to the master control unit and the slave control unit, wherein the slave control unit is controlled by the master control unit to drive the light-emitting diode light string; the transmission line is used to transit control signals and synchronous signals.

2. The driving apparatus for light-emitting diode curtain lamp in claim 1, wherein the slave control unit includes a signal processor.

3. The driving apparatus for light-emitting diode curtain lamp in claim 2, wherein the slave control unit includes a transistor electrically connected to the signal processor.

4. A driving apparatus for light-emitting diode curtain lamp applied to an alternating current power source and at least a light-emitting diode light string, the driving apparatus for light-emitting diode curtain lamp including:

a master control unit including a power negative terminal pin of master control unit and a signal output pin of master control unit, the master control unit being electrically connected to the alternating current power source; and at least a slave control unit including a signal input pin of slave control unit, a signal output pin of slave control unit, a power positive terminal pin of slave control unit, and a power negative terminal pin of slave control unit, the slave control unit being electrically connected to the master control unit and the light-emitting diode light string, wherein the slave control unit is controlled by the master control unit to drive the light-emitting diode light string; the signal output pin of master control unit is electrically connected to the signal input pin of slave control unit; the power negative terminal pin of master control unit is electrically connected to the power positive terminal pin of slave control unit.

5. The driving apparatus for light-emitting diode curtain lamp in claim 4, wherein the master control unit includes:

a microcontroller; and a bridge rectifier electrically connected to the microcontroller.

6. The driving apparatus for light-emitting diode curtain lamp in claim 5, wherein the master control unit includes a first Zener diode electrically connected to the bridge rectifier.

7. The driving apparatus for light-emitting diode curtain lamp in claim 6, wherein the slave control unit includes:

a signal processor;

a transistor electrically connected to the signal processor;

a second Zener diode electrically connected to the signal processor;

a third Zener diode electrically connected to the signal processor; and a fourth capacitor electrically connected to the signal processor.

8. A driving apparatus for light-emitting diode curtain lamp with single light-emitting diode in one light-emitting diode string applied to at least a light-emitting diode, the driving apparatus for light-emitting diode curtain lamp with single light-emitting diode in one light-emitting diode string including:

a master control unit; and at least a slave control unit electrically connected to the master control unit and the light-emitting diode, wherein the master control unit includes a microcontroller; the slave control unit includes a signal processor; the driving apparatus for light-emitting diode curtain lamp with single light-emitting diode in one light-emitting diode string further including:

an alternating current voltage transferring to direct current voltage circuit electrically connected to the slave control unit; and a second curtain lamp electrically connected to the alternating current voltage transferring to direct current voltage circuit.

* * * * *